United States Patent [19]

Valantin

[11] 4,114,385

[45] Sep. 19, 1978

[54] ROOF SUPPORT

[75] Inventor: Alfred Alphonse Marie Valantin, Clermont, France

[73] Assignee: Charbonnages de France, Paris, France

[21] Appl. No.: 858,064

[22] Filed: Dec. 6, 1977

[30] Foreign Application Priority Data

Dec. 7, 1976 [FR] France ..... 76 36769

[51] Int. Cl.[2] ..... E21D 15/44

[52] U.S. Cl. ..... 405/298

[58] Field of Search ..... 61/45 D; 299/31-33; 91/170 MP

[56] References Cited

U.S. PATENT DOCUMENTS

| | | | |
|---|---|---|---|
| 2,826,898 | 3/1958 | Joy | 61/45 D |
| 2,899,800 | 8/1959 | Joy | 61/45 D |

FOREIGN PATENT DOCUMENTS

| | | | |
|---|---|---|---|
| 1,030,282 | 5/1958 | Fed. Rep. of Germany | 61/45 D |
| 1,139,084 | 11/1962 | Fed. Rep. of Germany | 61/45 D |

*Primary Examiner*—Dennis L. Taylor

*Attorney, Agent, or Firm*—Cushman, Darby & Cushman

[57] ABSTRACT

A roof support for use in mines is moved by its own drive mechanism while under permanent load. The support comprises two side-by-side lower carriages with articulated tracks, cross members joining those carriages and an arm articulated to the cross members so as to swing up and down under the action of a jack connected between the arm and the cross members. At least one upper carriage having an articulated track is carried on the upper end of the arm, and is pushed against the roof of a mine gallery by the jack.

21 Claims, 15 Drawing Figures

ROOF SUPPORT

BACKGROUND OF THE INVENTION

The invention relates to a roof support capable of being moved by its own drive mechanism whilst under permanent load.

In U.S. patent application Ser. No. 808,548, filed June 21, 1977 there is described a roof support which is capable of being moved by its own drive mechanism whilst under permanent load, the support comprising at least two parallel lower carriages which rest on the floor of a mine gallery, and which are connected together by two connecting cross-members, at least one upper carriage which bears against the roof of the gallery and is directed parallel to the lower carriages, and a jack which extends under pressure to force apart the connecting cross-members of the lower carriages and a support for the upper carriage. The carriages of a roof support of this kind may have articulated tracks, with or without rollers.

In the above-mentioned patent application the applicant described various modifications comprising four roof supports and having considerable flexibility because the beam of each of the four articulated track carriages is divided into longitudinal elements. There is also described an embodiment with a single prop but in which the carriages have rigid beams.

An object of the present invention is to provide a new roof support having a single prop, but in which the beams can nevertheless be divided into longitudinal elements, so that the roof support can adapt readily to irregularities of the height to be supported.

Another object of the invention is to provide a roof support in which the possible variation of height between the lowest position and the highest position of the upper part of the support is considerably increased.

Roof supports in which one or two upper carriages are carried by an arm articulated to the end of extensions of two lower carriages have already been proposed, particularly in French Pat. Nos. 1,503,990; 2,265,970; 2,265,971, 2,287,580, but these arrangements require two jacks, one per lower carriage. Furthermore, these prior supports have to be relieved of load before they can be advanced and cannot be adapted for operation under permanent load.

Finally, the lower carriage and the upper carriage are necessarily each in one piece and there is no articulation other than that between the lower carriages, so that the flexibility permitted by the roof support of the invention is impossible.

For practical reasons it was not possible to use lower carriages with articulated tracks with a known roof support in which the upper carriage is carried by an arm articulated to the end of the lower carriage, because the height of the carriages and the presence of articulated tracks make it impossible for the lower carriage to carry an extension or a jack. A new approach was therefore necessary which resulted in the invention.

SUMMARY

A roof support according to the invention has at least two lower carriages which run on the floor of a mine gallery, and two cross members connecting the lower carriages together, which cross members are connected to the lower carriages by pivotal joints having at least two axes of rotation. The cross members are connected together by a lower longitudinal member to one end of which there is articulated an arm which swings up and down by the action of a jack connected between that arm and the lower longitudinal member. The free end of the arm carries a support for at least one upper carriage which bears on the roof of the gallery.

In the roof support of the invention the transfer of the point of application of the supported load to the lower longitudinal member connecting the two cross-members which connect the two lower carriages makes possible not only the use of a single jack but also permits articulated construction of the support, and in addition provides flexibility of adaptation of carriages with articulated tracks.

The lower longitudinal member many be fastened to one of said cross members; preferably the cross-member which is nearer the end of the longitudinal member to which the arm is articulated. The other cross-member is then connected to the lower longitudinal member by a pivot having a longitudinal axis.

It is advantageous for one of the two connections between the lower longitudinal member and the arm, and between the free end of the support for the upper carriage or upper carriages, to have at least 2° of angular freedom and for the other connection to have at most 1° of angular freedom.

In a first embodiment the articulated connection of the arm to the lower longitudinal member is a pivot whose axis is parallel to said cross-members. Two parallel upper carriages may be connected to said carriage support which comprises two upper cross-members which are carried at the free end of the arm by an upper longitudinal member. The upper longitudinal member and the arm may be connected by a pivot whose axis is orthogonal to the plane of oscillation of the arm.

In this embodiment it is advantageous for the two upper cross-members to be pivotally mounted on the upper longitudinal member by two substantially axially aligned pivots.

In a modification of this first embodiment, the connection of the arm to the lower longitudinal member is a cardan joint having a first pivotal axis parallel to the cross members connected to the lower longitudinal member, and a second axis oriented in the plane of oscillation of the oscillating arm. Two upper carriages which are parallel to each other may be joined together by a cross member of said carriage support which is a rigid assembly carried at the free end of the arm by a pivot whose axis is parallel to the first pivotal axis of said cardan joint connecting the arm to the lower longitudinal member.

Each carriage may comprise a beam for an articulated track, which beam is divided longitudinally into a number of elements.

It is also preferable for the beam elements of each upper carriage to be slightly separated longitudinally, and for the cross-members of said carriage support to be connected to the upper carriages by double swivel joints having at most two axes of rotation.

In this manner the maximum flexibility of adaptation to irregularities of the gallery is achieved.

The drive mechanism for each upper carriage may comprise a longitudinal jack carried by the carriage and so connected thereto as to act directly on the articulated track of that carriage.

In a modification the beam elements of each lower carriage are connected by a jack which is operable to move those elements towards or away from each other, and the cross member which is pivotally connected to the lower longitudinal member is arranged to slide on its pivot parallel to the direction of operation of the jacks of the lower carriages.

The driving jack of each carriage may include pawl means adapted to engage a shoe of the track of that carriage.

When the carriage comprises a beam which has rounded ends and is encircled by an articulated track which is mounted frictionally on the beam and on the rounded ends, the track is guided with lateral clearance on the straight portion of the beam in a guide path providing said lateral clearance and having at least one and at most two narrowed regions of reduced lateral clearance for the track.

BRIEF DESCRIPTION OF THE DRAWINGS

Some embodiments of the invention will now be described, by way of example, with reference to the accompanying drawings, in which.

DESCRIPTION OF THE PREFERRED EMBODIMENTS

Figure 1:
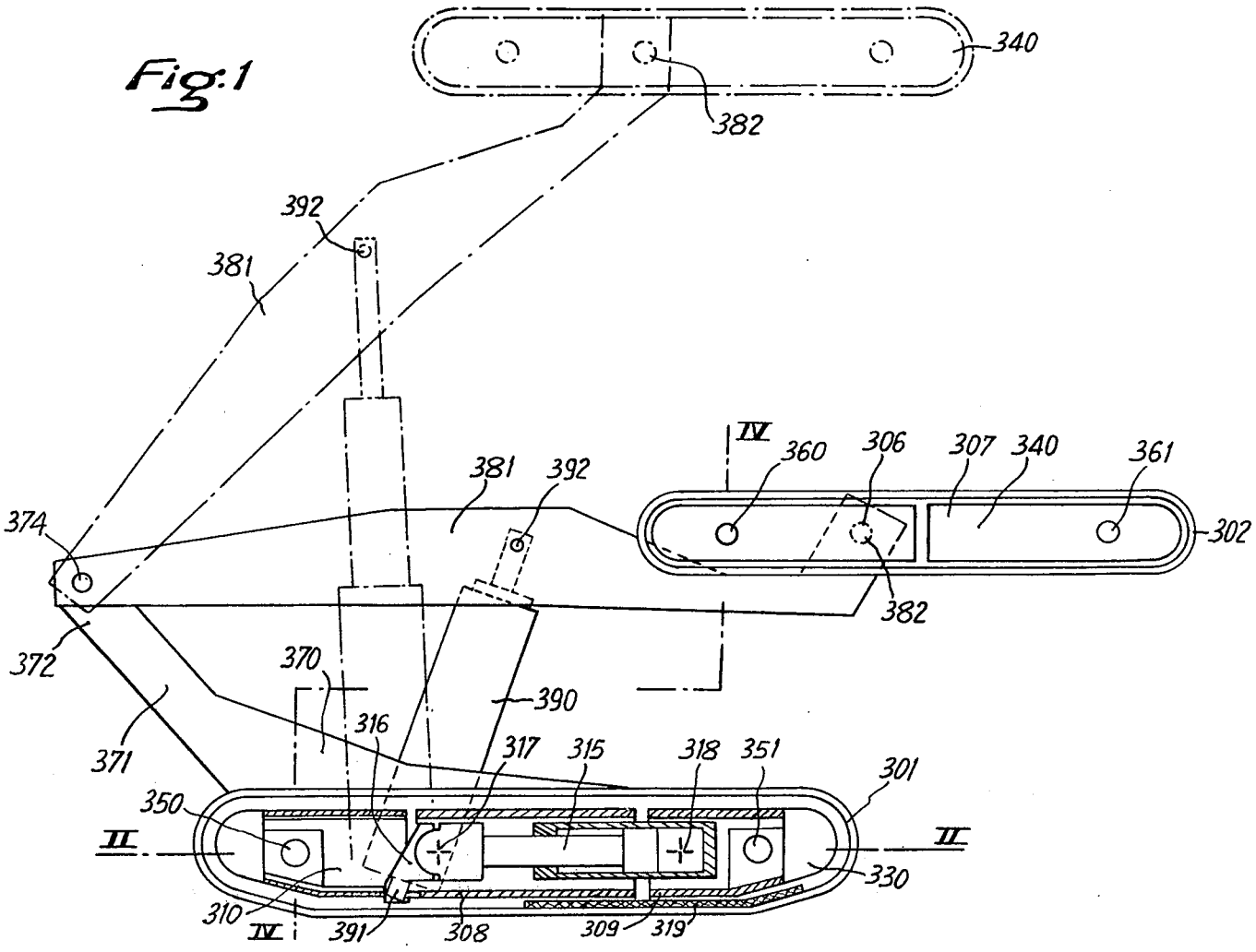
FIG. 1 is a view of a roof support according to the invention in longitudinal vertical section on the line I—I in FIG. 2.
Figure 4:
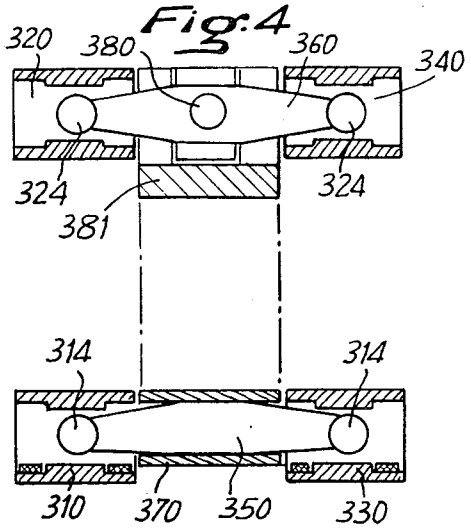
FIG. 4 is a view from the left in broken section along the line IV—IV in FIG. 1.
Figure 2:
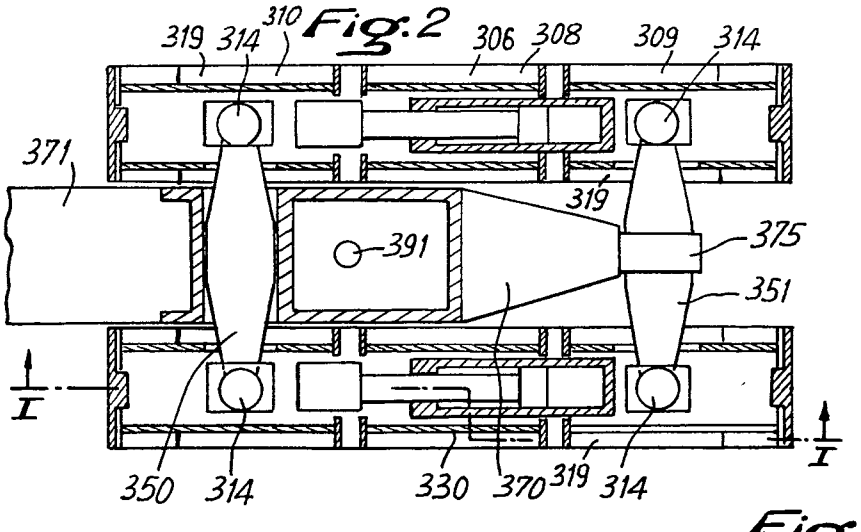
FIG. 2 is a view in horizontal section on the line II—II in FIG. 1.
Figure 3:
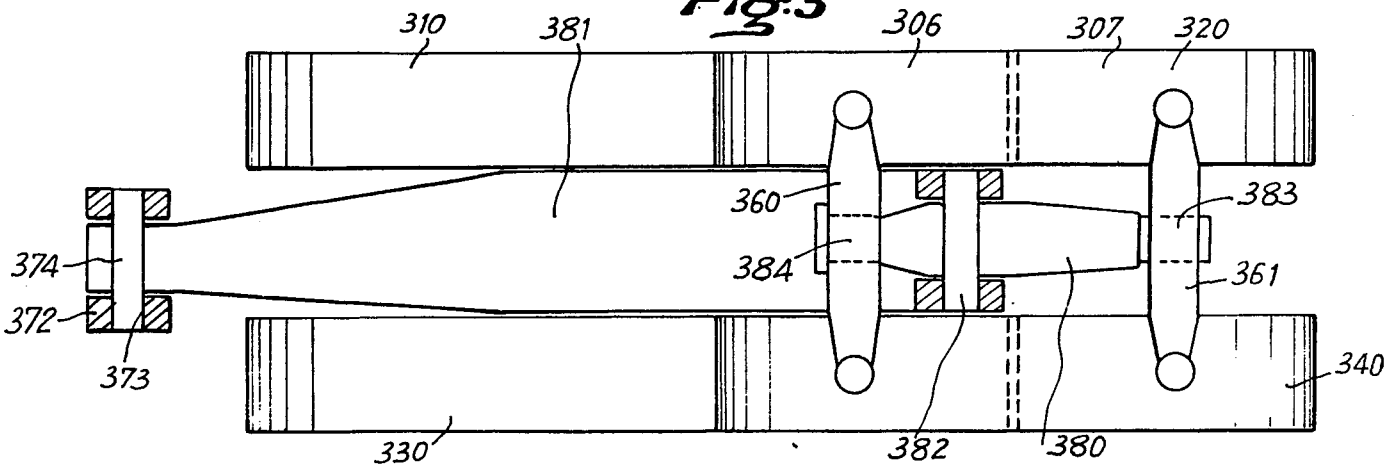
FIG. 3 is a top plan view of the roof support in FIGS. 1 and 2, an arm of the support being lowered into its lowest position as shown in FIG. 1.

The roof support shown in FIGS. 1 to 4 comprises four carriages indicated generally by the references 310, 320, 330, and 340, each with an articulated track and which are arranged in pairs as will be described below. Two carriages 310, 320, referred to herein as being the lefthand carriages, are a lower carriage 310 and an upper carriage 320 which are clamped between the floor and the roof as will be explained below. Two parallel carriages 330 and 340, referred to herein as being the right-hand carriages are of identical construction to the carriages 310 and 320.

Two cross-members 350 and 351 connect, in the region of their ends, the two lower carriages 310, 330, and two other cross-members 360 and 361 connect in the region of their ends the two upper carriages 320, 340.

The two cross-members 350 and 351 are connected by a longitudinal member 370, and the two cross-members 360 and 361 are connected by a longitudinal member 380.

The bottom longitudinal member 370 is extended at the rear of the support by a boom 371 which is secured to the member 370 and is directed obliquely upwards. The free end 372 of the boom 371, carries a bearing 373 for a pivot pin 374, on which there pivots an arm 381 which carries at its free end 382 the longitudinal member 380 on which the two cross-members 360, 361 of the upper carriages 320, 340 are pivotally mounted about substantially coaxial pivot pins 383 and 384 respectively.

The bottom longitudinal member 370 and its boom 371 are partly of box section, particularly near the connection of the longitudinal member to the cross-members 350 and 351, and partly of U-shaped section. The portion of the member 370 between the two cross-members 350 and 351 is of open U-section in order to receive at its bottom an attachment point 391 for one end of a jack 390 whose other end is attached to the arm 381 by a attachment point 392. To facilitate attachment to the jack the arm 381 is of box-section, at least in the region of the attachment point 382.

From the description given so far it can already be seen that in practice it is possible to utilise almost all the minimum height of the support to accomodate the jack 390, which makes it possible a considerable variation of height of the support by combining the extensibility of a relatively long jack with a relatively short lever arm for the articulated arm. With a three-element telescopic jack a variation of support height in the ratio of 1:3 and even higher may be achieved.

The roof support is capable of being moved by its own drive mechanisms which are entirely accommodated in the lower carriages 310 and 330, as will be described.

The bottom longitudinal member 370 and the rear cross-member 350 are locked on one another. Thus the assembly constituted by the lower carriages 310 and 330 and the cross-piece 350 establishes a good support base enabling the support to carry the load of the pressure of the roof. Nevertheless, in order to enable the lower carriages to adapt themselves satisfactorily to irregularities of the floor of the gallery, the cross-member 351 is pivotally mounted about a pivot pin 375 which is aligned axially of the cross-member 351, this axis being on a line joining the centres of the two cross-members 350 and 351.

The axis of the pivot pin 374 connecting the arm 381 to the boom 371 is parallel to the cross-member 350 which is fastened to the longitudinal member 370, and the axis of the pivotal connection 382 of the member 380 to the arm 381 is parallel to the axis 374.

The cross-members 350 and 351 are connected to the lower carriages 310 and 330 by four joints 314 of the spherical or cardan type, which permit limited movement, so as to reconcile good rigidity with the necessary adaptation to irregularities of the floor.

The carriages 310, 320, 330 and 340 each comprise a beam which has rounded ends and on which an articulated track 301 or 302 is loosely mounted. Each beam of the upper carriages comprises at least two elements 306, 307, which are connected only by the assembly supporting them, that is to say the assembly consisting of the upper longitudinal member 380, the cross-members 360 and 361 which are pivoted on the member 380, and the track 302 encircling the elements 306, 307. These elements 306, 307 are mounted about the cross-members 360 and 361 by double swivel joints 324 each having two axes at right angles which axes lie respectively in the direction of each cross-member 360 and 361 and in the longitudinal direction of each carriage.

The beam of each lower carriage consists of three elements 309, 306, 310 which are articulated to one another by spring blades 319. The end elements 309 and 310 are connected to the cross-members 350 and 351 by the joints 314.

The cylinder end of a propulsion jack 315 is connected to the end element 309 by a joint 318. A shoe 316 articulated at 317 on the free end of the piston rod of the jack 315 is shaped as a pawl 391 which engages in one of the shoes of the track 301. In known manner the extension of the jack effects linear displacement of the beam relative to the track, and by reaction the displacement of the roof support. Upon retraction of the jack the pawl 391 is disengaged, skips at least one shoe of the track and at the end of the retraction stroke of the piston of the jack 315 re-engages in another shoe.

Figure 5:
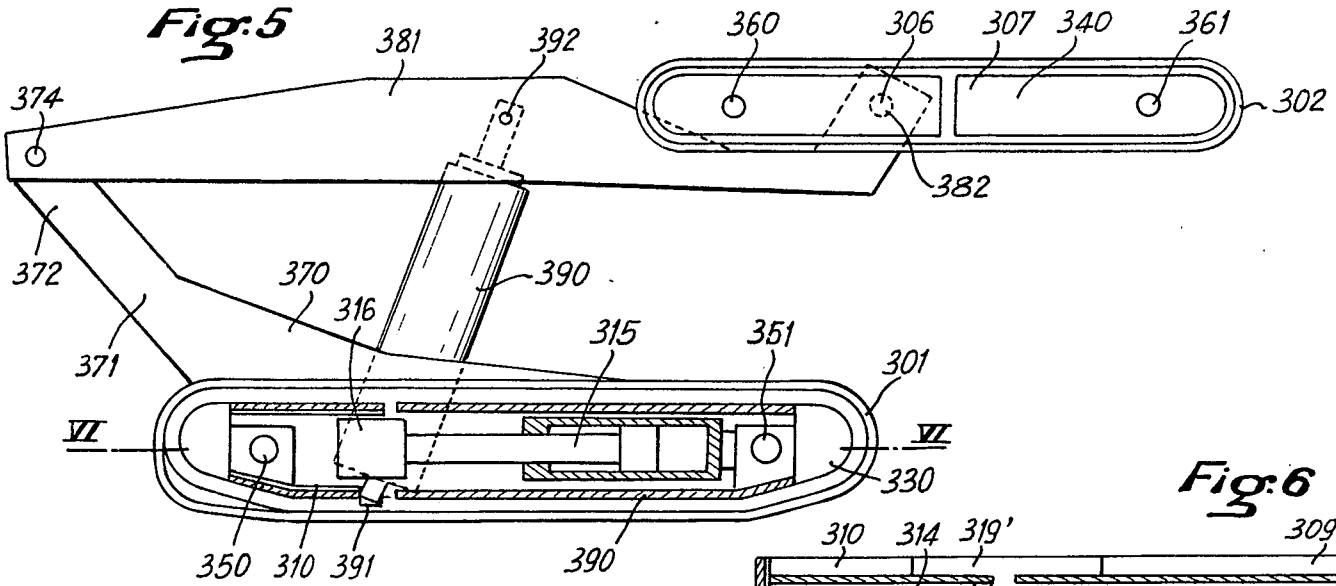
FIG. 5 is a view in longitudinal vertical section of a modified roof support according to the invention, taken on the line V—V in FIG. 6.
Figure 6:
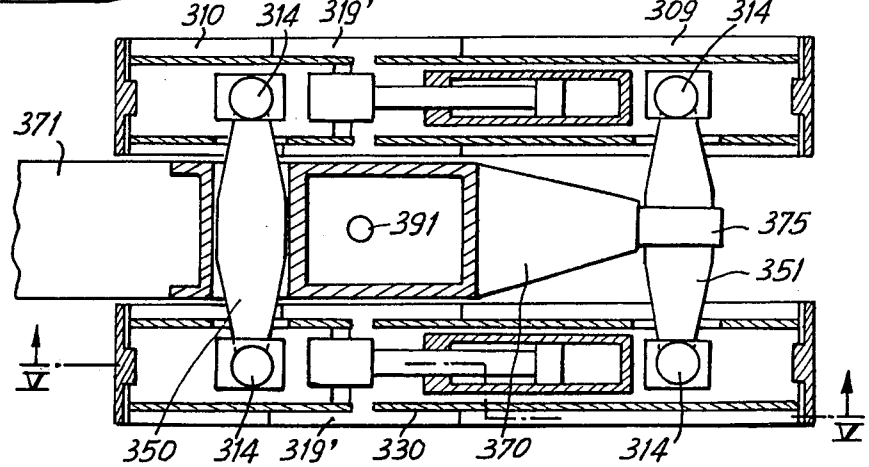
FIG. 6 is a view, similar to that of FIG. 2, of the modified embodiment of FIG. 5.

In the modified construction shown in FIGS. 5 and 6, the beam of each lower carriage consists of only two elements 309, 310 connected by a jack 315, which enables them to be moved away from or towards each other. In addition, the two elements 309 and 310 can swivel about the axis of the jack 315. Guide rails 319' may be connected longitudinally to one of the elements in a gap between that element and the track, which rails slide along the other element in a corresponding gap serving as slide guide.

Figure 7:
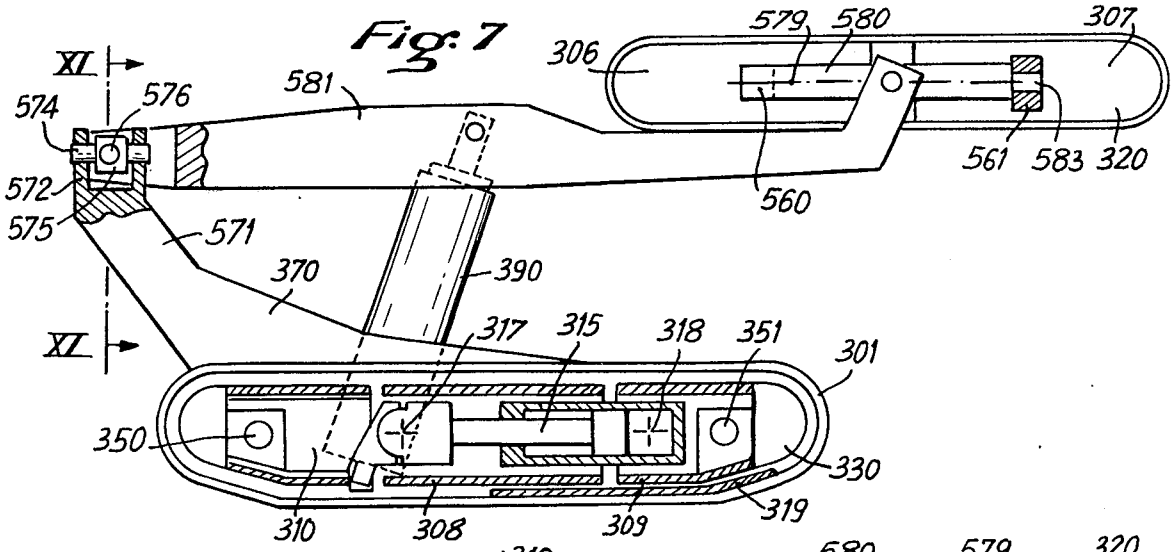
FIG. 7 is a view in longitudinal section of another modification of the roof support according to the invention, taken on the line VII—VII in FIG. 8.
Figure 8:
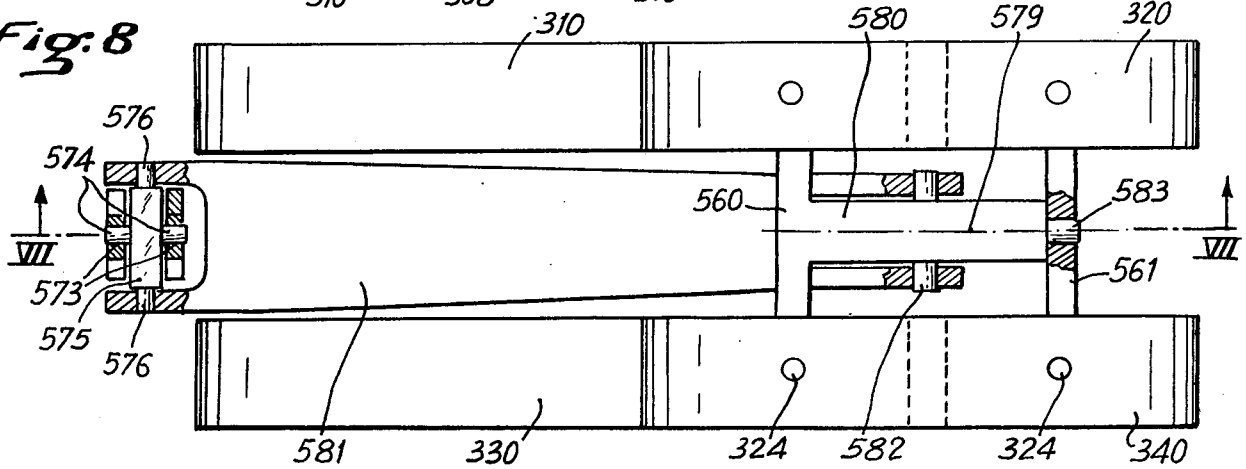
FIG. 8 is a top plan view of the roof support of FIG. 7, partly in section.
Figure 9:
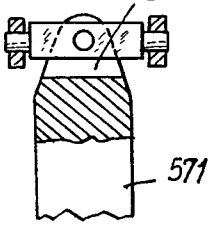
FIG. 9 is a vertical view in partial section on the line IX—IX in FIG. 7.

The roof support shown in FIGS. 7 to 9 comprises four carriages with articulated tracks, namely two lower carriages 310 and 330 and two upper carriages 320 and 340. The lower and upper carriages are clamped against the floor and the roof as previously. The two lower carriages 310 and 330 are identical in construction to those of the roof support illustrated in FIGS. 1 to 4, or in FIGS. 5 and 6. They are connected in the same manner by two cross-members 350 and 351, which are connected by a longitudinal member 370 which is extended towards the rear by a boom 571 integral therewith and directed obliquely upwards.

The free end 572 of the boom 571 carries an oscillating arm 581 mounted by a cardan joint with the aid of a cross trunnion 575 of which trunnion 576 permits oscillation of the arm 581 in the plane of symmetry of the roof support. The trunnion 576 is therefore parallel to the cross-member 350 fastened to the longitudinal member 370, that is to say practically horizontal. The second trunnion 574 of the cross trunnion 575 is carried by a double bearing 573 on the end 572 of the boom, the axis of the trunnion 574 being oriented towards the arm 581 and being horizontal or slightly inclined.

At its free end the arm 581 carries H-shaped carrier assembly 579. This carrier assembly 579 comprises a longitudinal central element 580 and two cross-members 560, 561. The central element is pivotally mounted on the free end of the arm 581 by means of a joint including a transverse trunnion 582. The cross-member 560 is fastened to one end of the central element 580. The cross-member 561 is mounted for oscillation about a trunnion 583 whose axis is longitudinal and which is carried on the opposite end of the central element 580.

The upper carriages 320 and 340 comprise beams which have rounded ends and on which articulated tracks are loosely mounted. Each beam of the carriages 320 and 340 consists of two elements 306, 307, which are connected only by the assembly 579. The elements 306, 307 are mounted about the cross-members 560 and 561 by double swivel joints 324 whose axes are at right angles to one another and which are disposed respectively in the direction of each cross-member and in the direction of each carriage. It is for this reason that, although the assembly comprising the two upper carriages 320, 340 is mounted on the arm 581 by a joint 582 having only one degree of freedom, it is necessary to provide the joint 583 which, without forming part of the connection between the carriages and the arm, enables the joints 324 to play their part fully of articulation within the assembly of the upper carriages.

Figure 10:
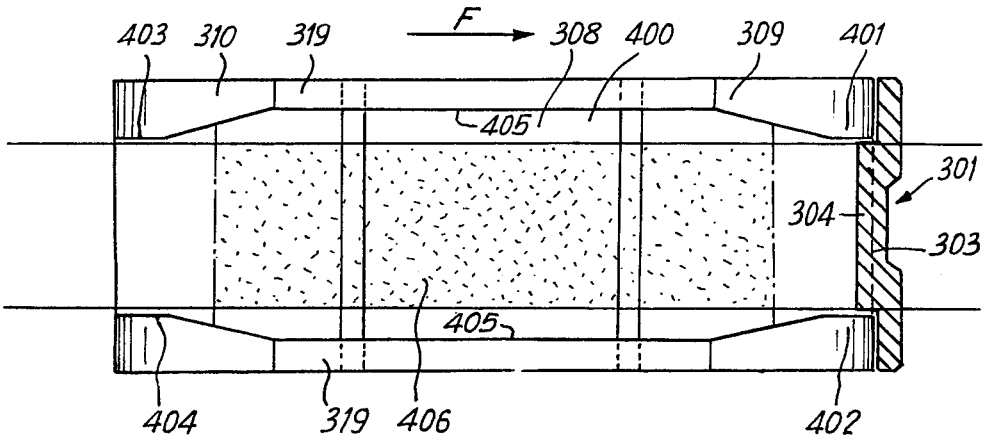
FIGS. 10 and 11 show, in the form of views from below of a beam comprised in the lower part of the roof support of FIGS. 1 to 4, one form of the guide path of the beam of a roof support according to the invention.
Figure 11:
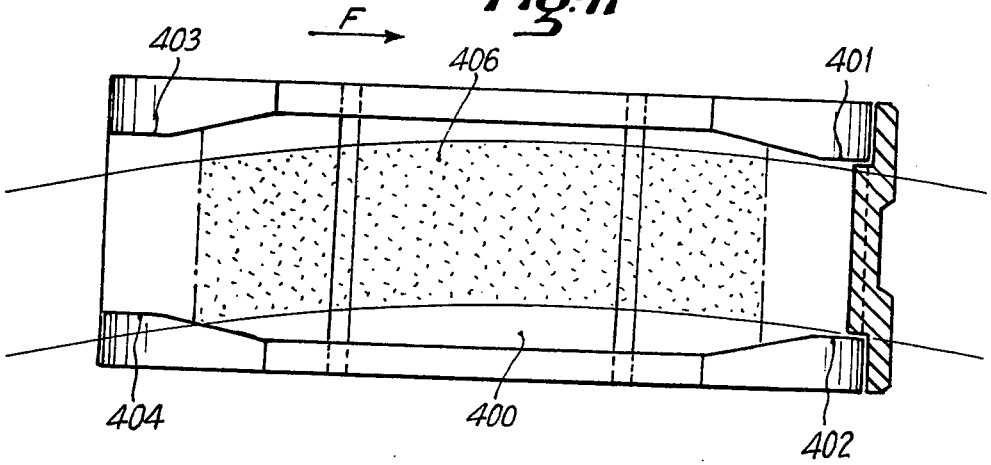

FIGS. 10 and 11 are views from below the beam of one of the lower carriages 310 or 330 of the roof support of FIGS. 1 to 4. At the right-hand end of each carriage there is shown in cross-section a shoe 303 of the track 301 which shoe has a guide heel 304 which guides the track in a guide path 400 formed under the elements 310, 308, 309 of the beam. In its central portion this guide path has lateral clearance relative to the path of the guide heels 304, which clearance occurs on each side of the part 406 of the track 301 which is in contact with the ground and is shaded in FIGS. 10 to 15. This guide path 400 therefore has two lateral recesses 405 relative to two pairs of end bosses 401 to 404.

The distance separating the two bosses of each pair is such that the bosses guide the track 301 substantially without play.

As is explained below, this special arrangement enables the roof support to travel around a curve.

If during movement of the roof support the movement of one lower carriage is intentionally interrupted, continuing movement of the other lower carriage causes the support to pivot substantially about its centre, so that, as shown in FIG. 10, the guide bosses 401 and 402 push laterally the shoes of the track which bosses are situated at the forward end of the corresponding beams considered in the direction of advance F of the support so that the track is guided without play. Each shoe 303 of the track is therefore offset laterally relative to the preceding shoe as it is laid down, and the succession of shoes thus laid down form a curve whose direction is given by the pivoting of the beam which is slidlingly guided on the shoes which are laid down in front of it. The beam follows the path of these shoes, so that the recesses 405 permit the track to assume the curved shape shown in FIG. 11.

The embodiment described above is very suitable for the movement of the roof suport and enables the support to travel around a bend in cases where the roof and the floor are regular and substantially horizontal.

In other applications whether the path is curved or straight, the forces applied to the track shoes in contact with the ground may offset them laterally, and this offsetting may be so great that the side faces of the shoes rub against the surface of the recess 405 facing the convex edge of the track, which would be detrimental to satisfactory advance of the support and may cause premature wear both of the recess and of the side faces of the shoes.

If this occurs when the support is following a straight path, it may subsequently be impossible for the support to move around a curve.

FIGS. 12 to 15 show modifications which enable these disadvantages to be avoided.

Figure 12:
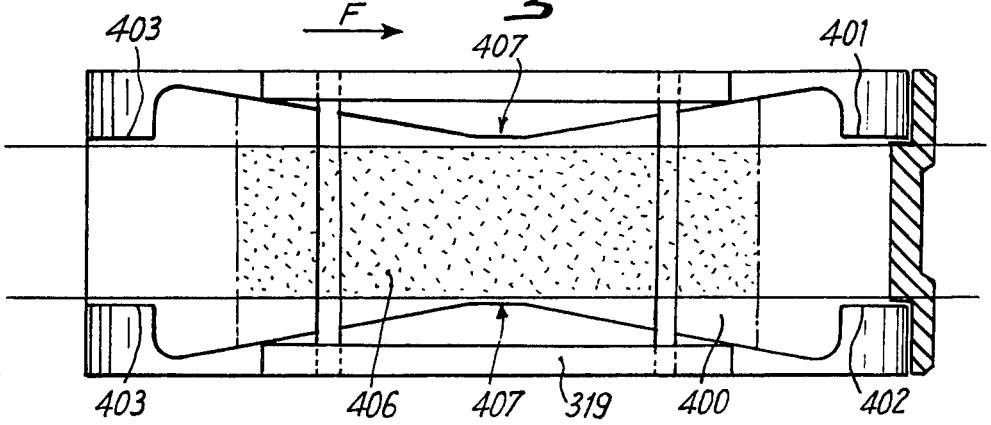
FIGS. 12 to 15 show, in views similar to FIGS. 10 and 11, two other constructions of the lower beam.
Figure 13:
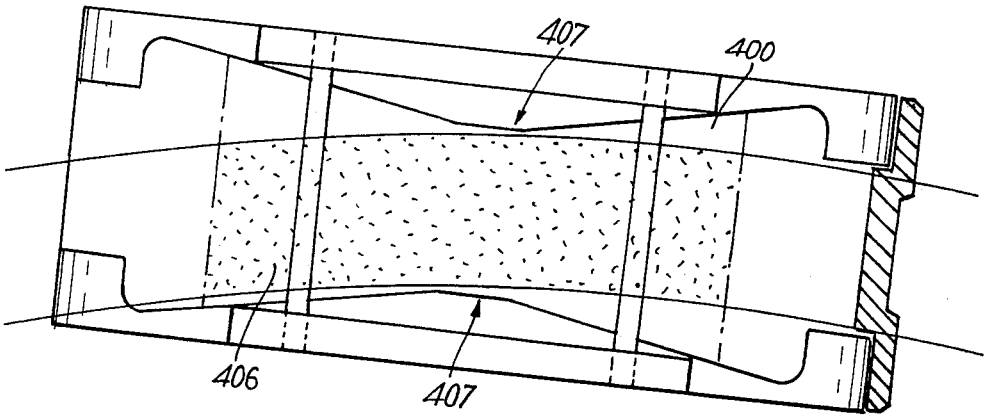

In FIGS. 12 and 13 the recess between the bosses 401 and 402 and the bosses 403 and 404 are shaped with two bosses 407 defining a narrowed gap whose width is substantially equal to that of the gaps between the bosses 401 and 402 and between the bosses 403 and 404.

Figure 14:
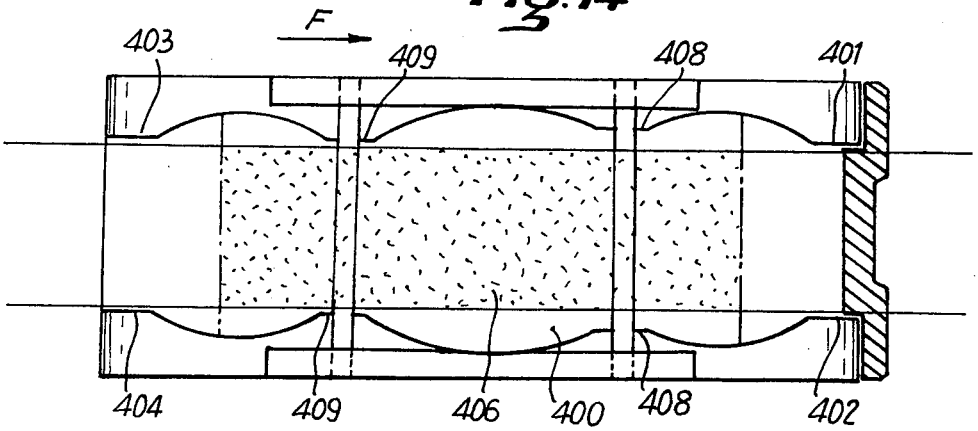
Figure 15:
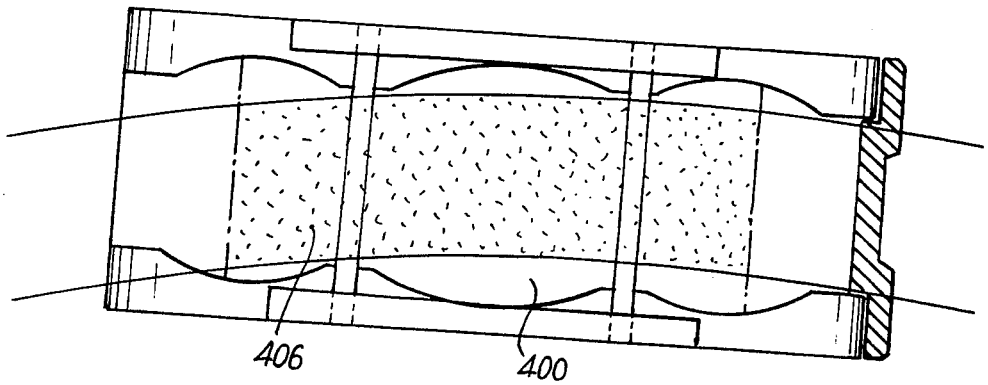

In FIGS. 14 and 15 the recess is provided with two pairs of bosses 408 and 409, the width of the gap between the bosses 409 situated near the bosses 403 and 404 being substantially equal to the distance separating the bosses 403 and 404, while the width of the gap between the bosses 408 is greater than the distance separating the bosses 401 and 402.

As well as reducing surface contact between the sides of the recess and the shoes, and therefore reducing their time of contact and their wear, these narrowed portions make it possible to avoid lateral offsetting of the lower carriages in relation to the desired path, whether straight or curved.

I claim:

1. A roof support which is capable of being moved by its own drive mechanism whilst under permanent load, comprising:

at least two lower carriages;

two cross members connecting the lower carriages together, which cross members are connected to the lower carriages by pivotal joints having at least two axes of rotation;

a lower longitudinal member connecting said two cross members together;

an arm articulated to one end of said lower longitudinal member, which arm swings above said longitudinal member;

a carriage support carried by the free end of said arm;

at least one upper carriage carried by said support and oriented parallel to the lower carriages; and jack means connected between said lower longitudinal member and said arm and operable to vary the separation between said carriage support and the lower carriages.

2. A roof support according to claim 1, wherein the lower longitudinal member is fastened to one of said cross-members.

3. A roof support according to claim 2, wherein the lower longitudinal member is fastened to the cross-member nearer the end of the longitudinal member to which the arm is articulated.

4. A roof support according to claim 2, wherein the cross-member which is not fastened to the longitudinal member is connected to the longitudinal member by a pivot having a longitudinal axis.

5. A roof support according to claim 1, wherein the connection between the lower longitudinal member and the arm has at least 2° of angular freedom and the connection between the free end of the arm and the carriage support has at most 1° of angular freedom.

6. A roof support according to claim 1, wherein the connection between the free end of the arm and the carriage support has at least 2° of angular freedom, and the connection between the lower longitudinal member and the arm has at most 1° of angular freedom.

7. A roof support according to claim 6, wherein the articulated connection of the arm to the lower longitudinal member is a pivot whose axis is parallel to said cross-members.

8. A roof support according to claim 1, wherein two parallel upper carriages are connected to said carriage support which comprises two upper cross-members which are carried at the free end of the arm by an upper longitudinal member.

9. A roof support according to claim 8, wherein the upper longitudinal member and the arm are connected by a pivot whose axis is orthogonal to the plane of oscillation of the arm.

10. A roof support according to claim 9, wherein the two upper cross-members are pivotally mounted on the upper longitudinal member by two substantially axially aligned pivots.

11. A roof support according to claim 5, wherein the connection of the arm to the lower longitudinal member is a cardan joint having a first pivotal axis parallel to the cross-members connected to the lower longitudinal member, and a second axis oriented in the plane of oscillation of the arm.

12. A roof support according to claim 11, comprising two upper carriages which are parallel to each other are joined together by a cross-member of said carriage support which is a rigid assembly carried at the free end of the arm by a pivot whose axis is parallel to the first pivota axis of said cardan joint connecting the arm to the lower longitudinal member.

13. A roof support according to claim 1, in which each carriag comprises a beam for an articulated track, which beam is divided longitudinally into a number of elements.

14. A roof support according to claim 13, comprising two upper carriages which are parallel to each other and are connected together by cross members of said carriage support, the beam elements of each upper carriage being slightly separated longitudinally, and the cross-members of said carriage support being connected to the upper carriages by double swivel joints having at most two axes of rotation.

15. A roof support according to claim 1, wherein each lower carriage has an articulated track and the drive mechanism for each lower carriage comprises a longitudinal jack carried by the carriage and so connected thereto as to act directly on the articulated track of that carriage.

16. A roof support according to claim 13, wherein the beam of each lower carriage comprises beam elements which are connected by a jack which is operable to move those elements towards or away from each other, one of said cross-members is connected to said lower longitudinal member by a pivot having a longitudinal axis, and said cross-member is arranged to slide on said pivot parallel to the direction of operation of the jacks of the lower carriages.

17. A roof support according to claim 16, wherein the driving jack of each carriage includes pawl means adapted to engage a shoe of the track of that carriage.

18. A roof support according to claim 1, wherein each carriage comprises a beam which has rounded ends and is encircled by an articulated track which is mounted frictionally on the said beam and on its rounded ends, which track is guided with lateral clearance on the straight portion of the beam and without play around the rounded ends of the beam.

19. A roof support according to claim 17, wherein the beam of at least each lower carriage is formed in its straight portion with a guide path for the track with lateral clearance and including at least one and at most two narrowed regions of reducing lateral clearance for the track.

20. A roof support according to claim 19, in which each beam is formed with a guide path having two narrowed zones of unequal width.

21. A roof support according to claim 20, wherein the rearward narrowed zone is narrower than the forward narrowed zone considered in the direction of advance of the roof support.

* * * * *